US012145766B2

(12) United States Patent
Anderson et al.

(10) Patent No.: US 12,145,766 B2
(45) Date of Patent: Nov. 19, 2024

(54) COMPACT WALL PANEL DECK BOX KIT

(71) Applicant: Suncast Technologies, LLC, Palm Beach Gardens, FL (US)

(72) Inventors: Torrence Anderson, Overland Park, KS (US); Stephen Whitehead, Elgin, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 205 days.

(21) Appl. No.: 17/411,194

(22) Filed: Aug. 25, 2021

(65) Prior Publication Data

US 2023/0067173 A1 Mar. 2, 2023

(51) Int. Cl.
*B65D 6/24* (2006.01)
*B65D 6/34* (2006.01)

(52) U.S. Cl.
CPC ..... *B65D 11/1873* (2013.01); *B65D 11/28* (2013.01)

(58) Field of Classification Search
CPC ..... B65D 11/1873; B65D 21/083; B65D 21/0204; B65D 81/361; B65D 88/005; B65D 90/023; B65D 90/026
USPC ..... 220/4.28, 621
See application file for complete search history.

(56) References Cited

U.S. PATENT DOCUMENTS

| | | | | | |
|---|---|---|---|---|---|
| 4,836,395 | A * | 6/1989 | Goutille | B65D 88/121 | 220/4.28 |
| 5,204,149 | A * | 4/1993 | Phenicie | F16B 5/0056 | 428/57 |
| 5,413,236 | A * | 5/1995 | Kenevan | B65D 21/083 | 220/4.27 |
| 5,597,084 | A * | 1/1997 | Parasin | B65D 11/1873 | 220/4.28 |
| 7,467,502 | B1 * | 12/2008 | Syla | E04B 2/7401 | 312/265.5 |
| 8,181,806 | B2 * | 5/2012 | Hidalgo Vargas | B65D 11/1833 | 220/4.28 |
| 2016/0090209 | A1 * | 3/2016 | Brisendine | B65D 19/18 | 108/56.1 |
| 2017/0035177 | A1 * | 2/2017 | Cataudella | B65D 11/20 | |
| 2020/0277105 | A1 * | 9/2020 | Longo | B65D 43/0202 | |
| 2021/0188480 | A1 * | 6/2021 | Pruvost | B65D 15/24 | |
| 2021/0237391 | A1 * | 8/2021 | Kisielinski | B32B 27/08 | |

* cited by examiner

*Primary Examiner* — Robert Poon
(74) *Attorney, Agent, or Firm* — McHale & Slavin, P.A.

(57) ABSTRACT

A deck box kit formed from injection molded split plastic panels that interlock with an adjoining panel to form top, bottom, front and rear walls. The adjoining panels are secured in position with screw fasteners, and utilize integrally formed cross bracing, ribs and gussets for increased rigidity. In a disassembled state, the panels are substantially the same size, allowing efficiency in storage and reduced shipping costs by employing substantially square packaging. Further, the panels are stored in a nested configuration to eliminate the shipping of containers requiring fillers to address free air space.

12 Claims, 25 Drawing Sheets

COMPACT WALL PANEL DECK BOX KIT

FIELD OF THE INVENTION

This invention relates generally to storage containers constructed of plastic structural panels; and, more specifically, to a deck storage box utilizing injection molded split plastic panels capable of being packaged and shipped in a knocked-down and compact configuration using a shipping container that is half the length of a conventional deck box shipping container.

BACKGROUND INFORMATION

Plastic storage containers for household items and the like are well known. Patios, porches, swimming pools, balconies, and boat docks are just a few places that benefit from weather-resistant storage containers. For ease of explanation, such containers will be referred to as a deck box, which is a term that may be used interchangeably with dock box, patio box, storage box, container box, storage container, or the like descriptive terms.

Deck boxes may be used to store gardening supplies, pool supplies, beach supplies, furniture covers/cushions, towels, toys and so forth, all subject to the owner's individual preference. The deck box is typically rectangular shaped, defining a storage area having front and rear walls, opposing end walls, a bottom wall, and a hinged cover.

Deck boxes employ blow molded or extruded panels coupled together with connector members that facilitate an engagement between the panels to form a complimentary edge configuration. For ease of storage and shipping, the deck boxes are manufactured in a disassembled configuration wherein the panels are coupled together to form the deck box by the end consumer. Applicant's prior registrations directed to such storage containers includes: U.S. Pat. Nos. 5,464,115; 7,028,859; 8,689,992; USD421181; USD429418; USD593773; USD647299; USD658374; USD715049; USD715050; USD717542; USD723803.

While conventional deck boxes are sold in a disassembled state, the associated packaging remains a long rectangular shape. Such packaging includes air space, as the wall panels are not the same length. In particular, a conventional deck box has wall panels to form the bottom, front, rear, and cover. A short panel is used to form the end walls. The result is a rectangular shipping carton that requires packing material to fill dead air space, as the end walls are dissimilar in size to the wall lengths. In addition, oblong shipping cartons may cost more to store and ship due to length.

What is lacking in the industry is a deck box formed from wall panels that can be stacked and nested to provide compact storage and shipping by use of substantially square packaging.

BRIEF DESCRIPTION OF THE INVENTION

The present invention provides a kit formed from injection molded plastic panels which combine to form a deck storage box. The panels interlock with an adjoining panel to form top, bottom, front and rear walls. The adjoining panels are secured in position with screw fasteners. Injection molding allows the panels to be formed with integral cross-bracing, ribs and gussets for increased rigidity. In a disassembled state, the panels are substantially the same size, allowing efficiency in storage and reduced shipping costs by employing substantially square packaging. Panels are stored in a nested configuration to eliminate the shipping of containers requiring fillers to address free air space.

An objective of the invention is to provide a deck box that can be easily manufactured, packaged and shipped using multiple wall panels while providing structural integrity combined with modularity and excellent aesthetic appearance in concealing wall panel joints.

Another objective of the invention is to provide a compact wall panel deck box which resists panel separation, buckling, racking and weather infiltration.

Still another objective of the invention is to provide security for stored items, wherein the wall panels are substantially the same size and connect in such a way as to unify the entire enclosure.

Yet another objective of the invention is to provide a deck box formed from relatively few component parts that are inexpensive to manufacture by conventional techniques. The deck storage box must also be capable of being packaged and shipped in a knocked-down and nested state to minimize or avoid a package having air voids.

Still another objective of the invention is to provide a deck box that meets ergonomic needs to achieve acceptance by the end user. The deck box is easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting deck storage box or otherwise detract from the internal storage volume of the resulting deck storage box, or otherwise negatively affect the utility of the deck storage box.

Another objective of the present invention is to provide a deck box with integrated connectors which accommodates injection molding plastic formation of the panel components for increased structural integrity.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DESCRIPTION OF THE PREFERRED EMBODIMENT

Figure 1:
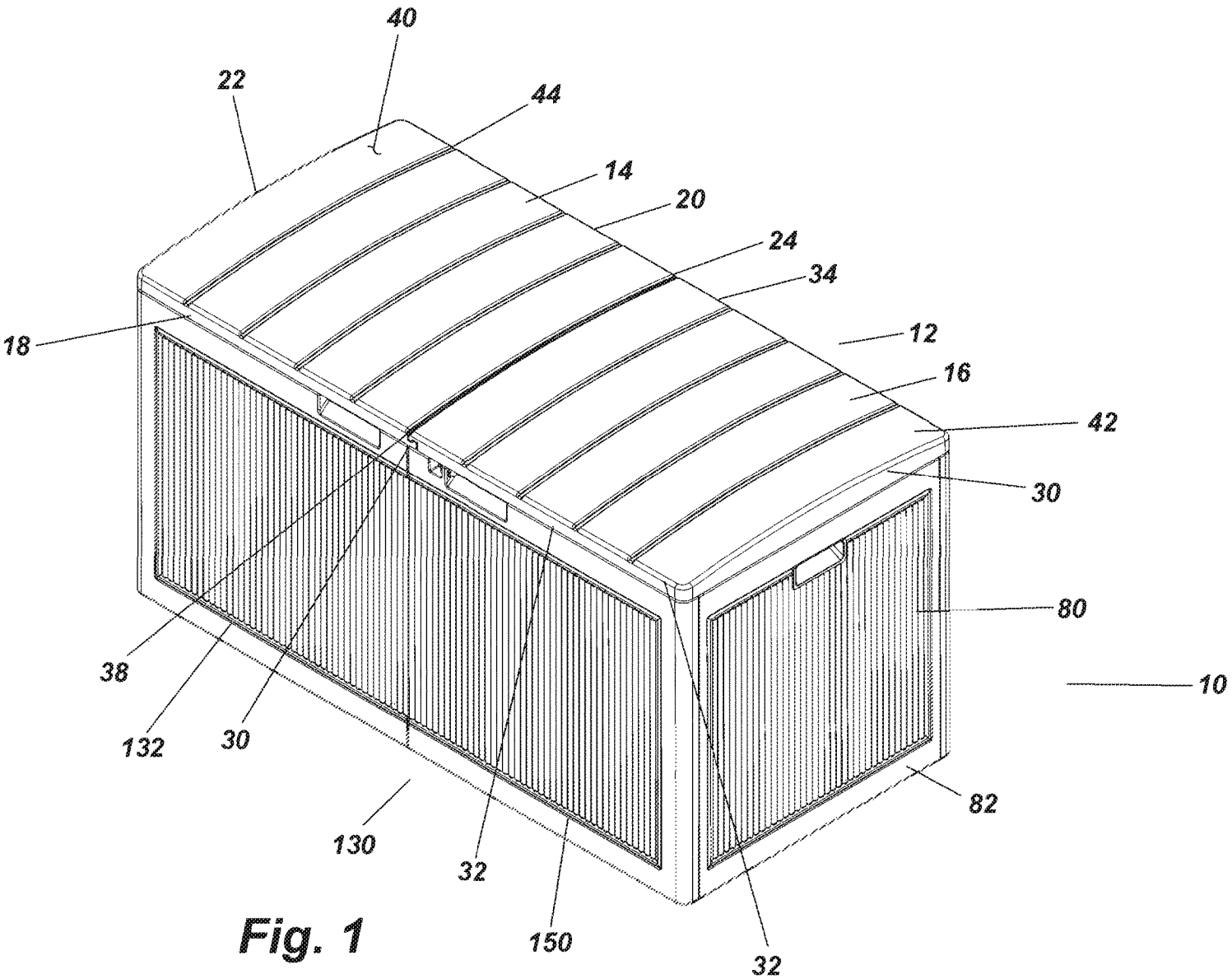
FIG. 1 is a right front perspective view of the deck box storage container.
Figure 2:
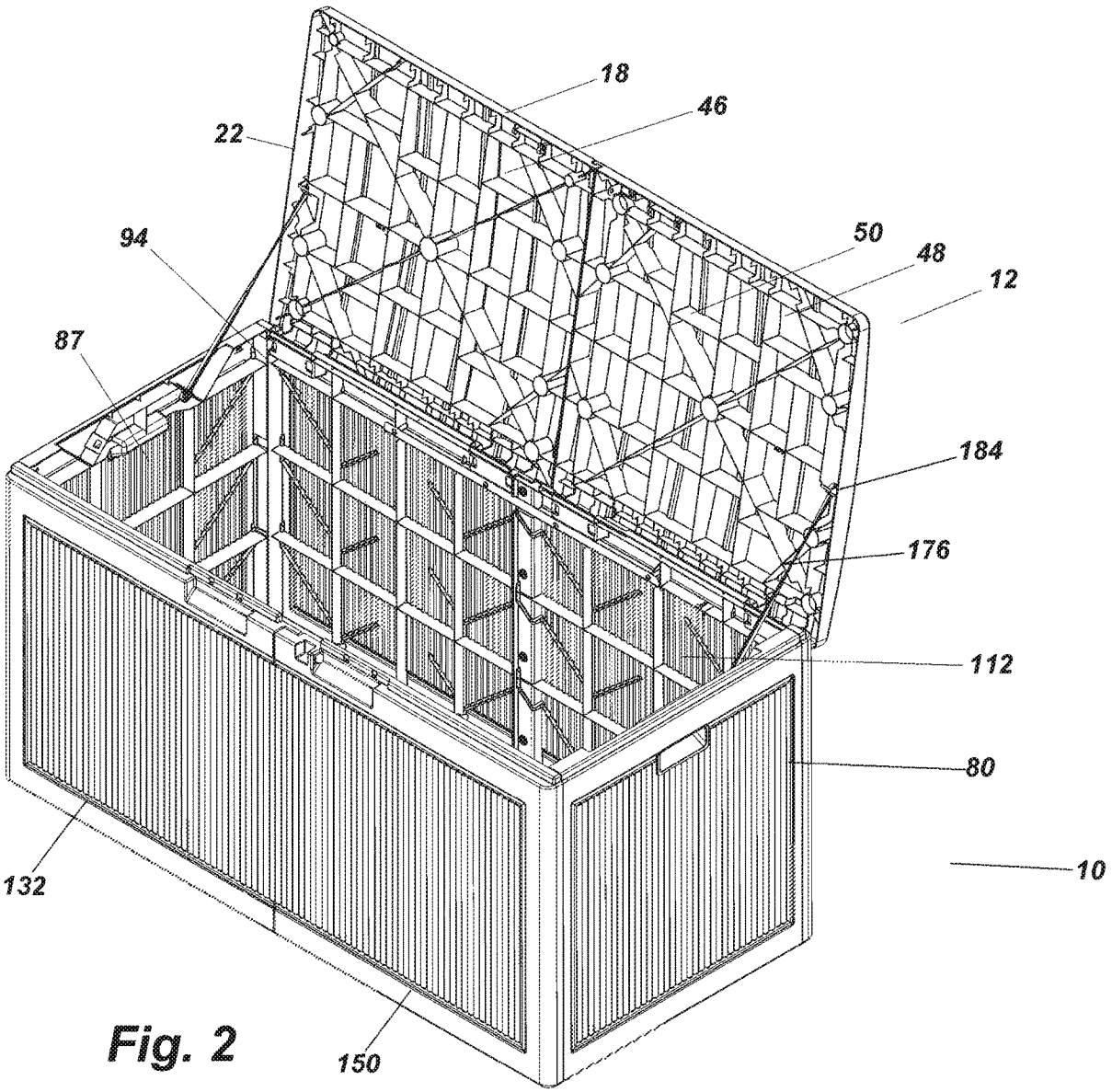
FIG. 2 is a right front perspective view of the deck box with the cover in the open position.
Figure 3:
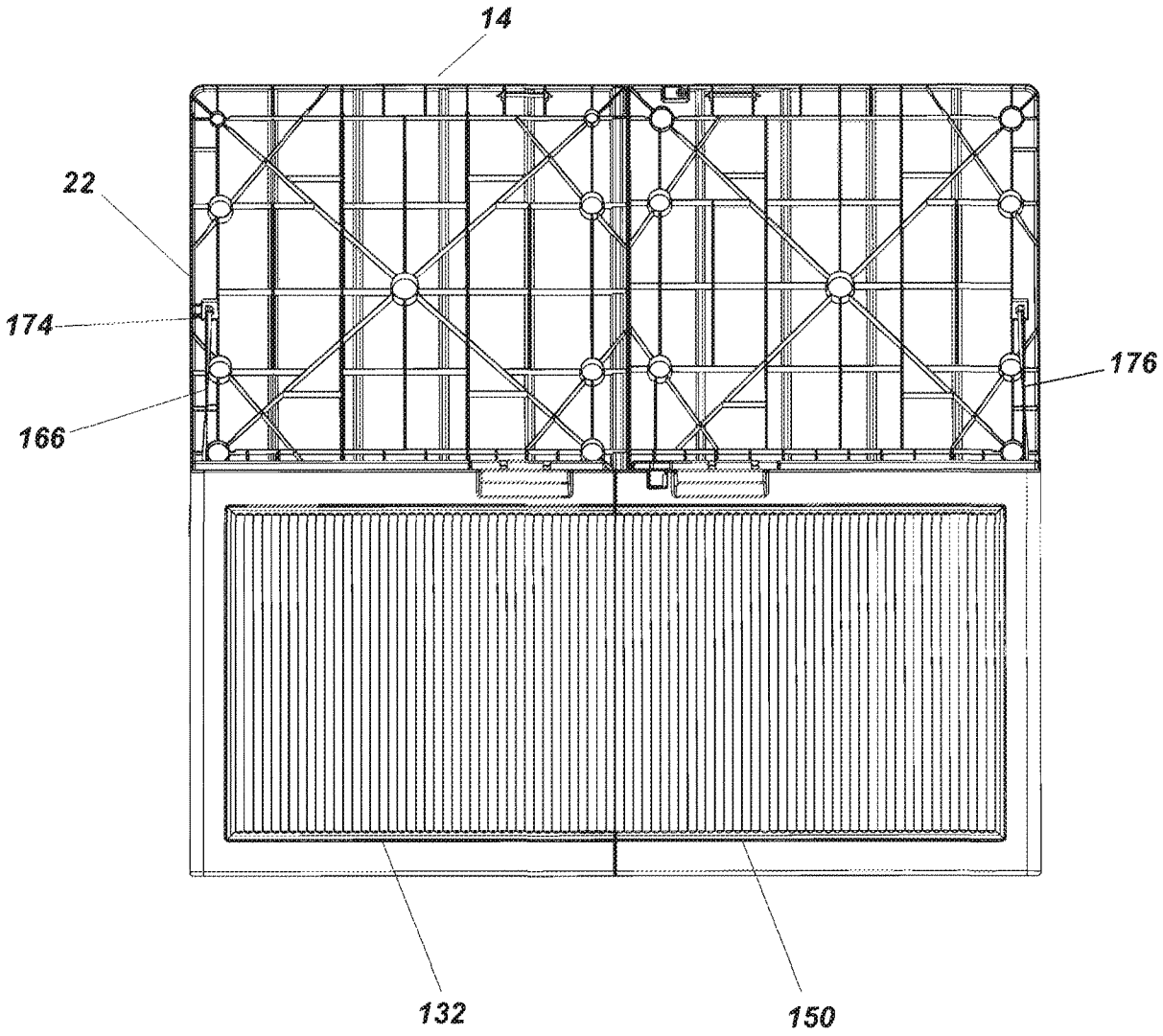
FIG. 3 is a front plane view of the deck box with the cover in the open position.
Figure 4:
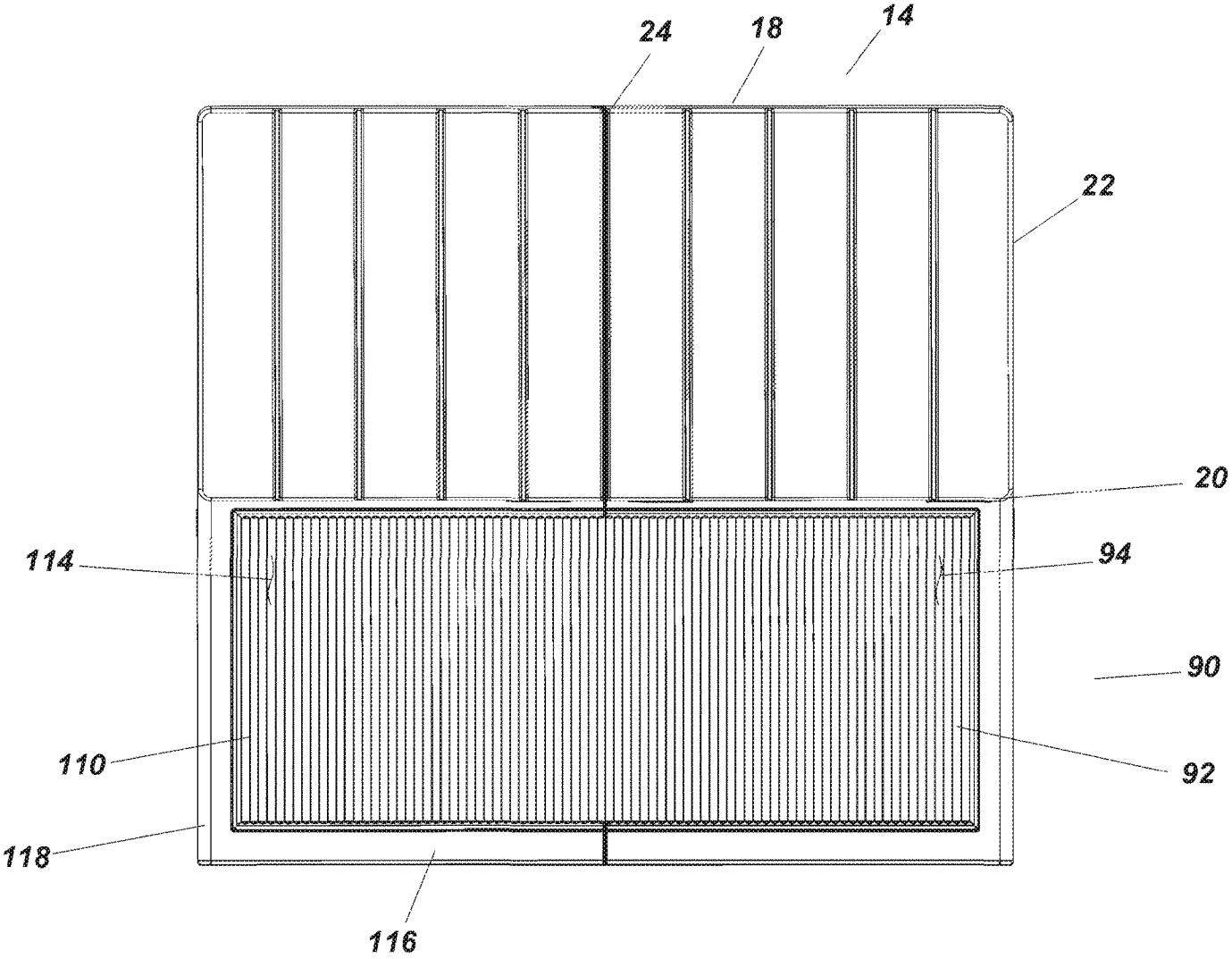
FIG. 4 is a rear plane view of the deck box with the cover in the open position.
Figure 5:
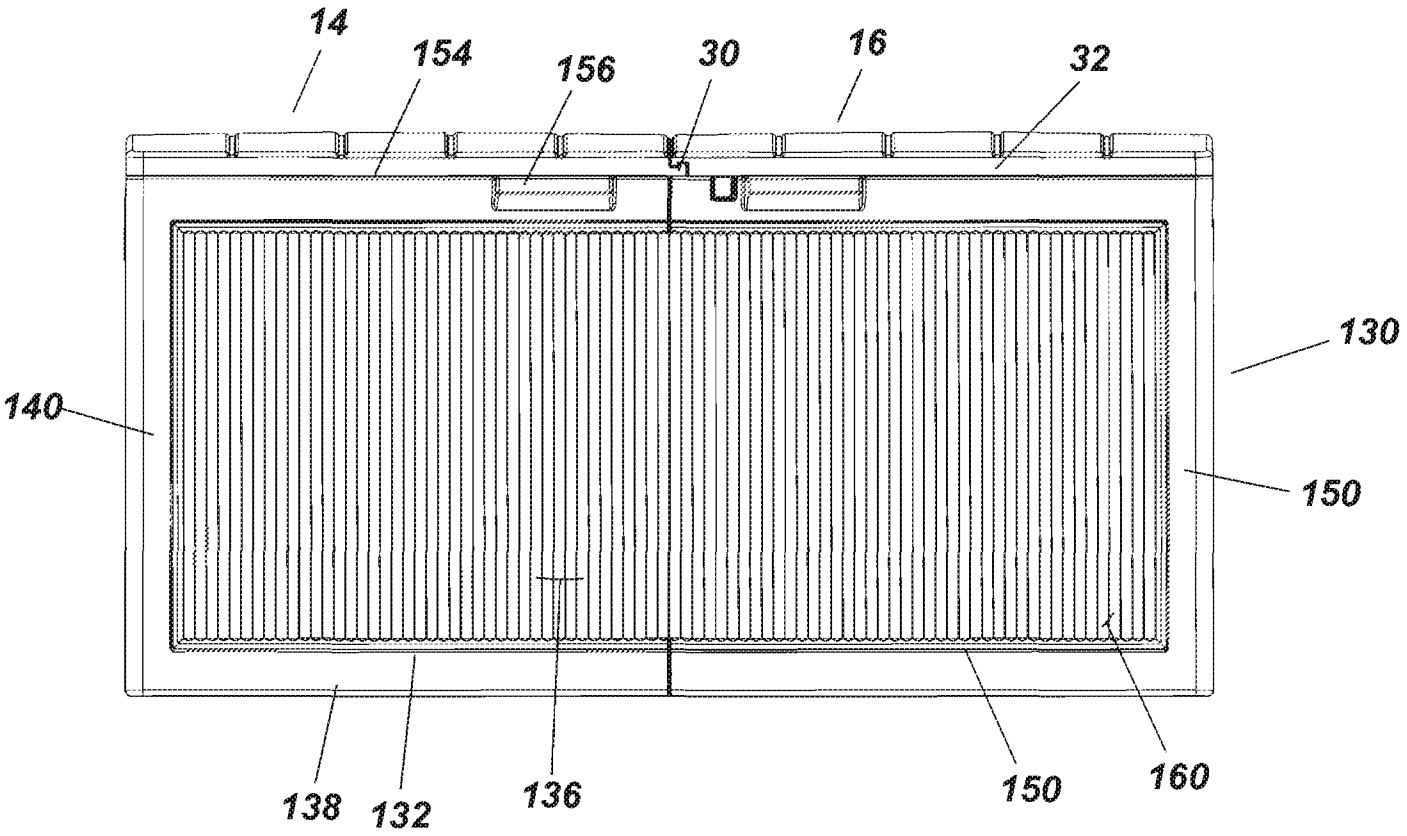
FIG. 5 is a front plane view of the deck box with the cover in the closed position.
Figure 6:
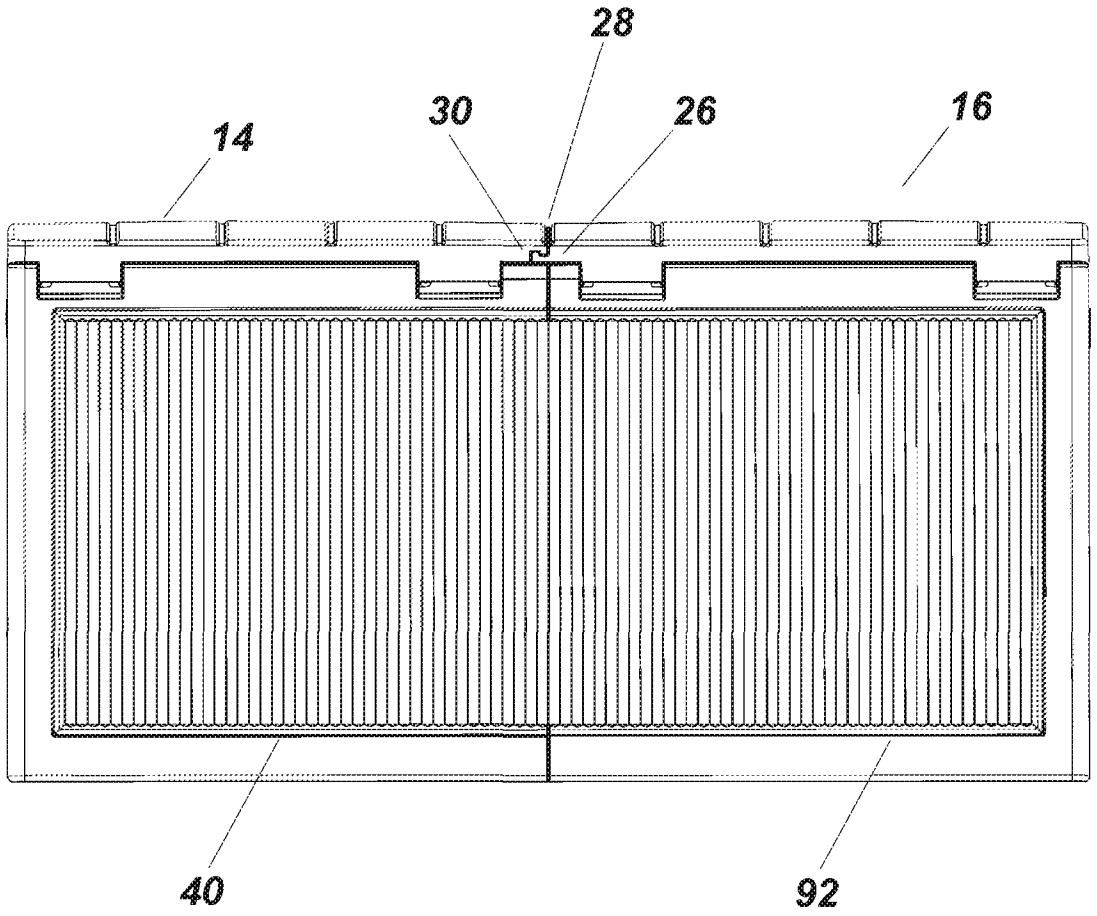
FIG. 6 is a rear plane view of the deck box with the cover in the closed position.
Figure 7:
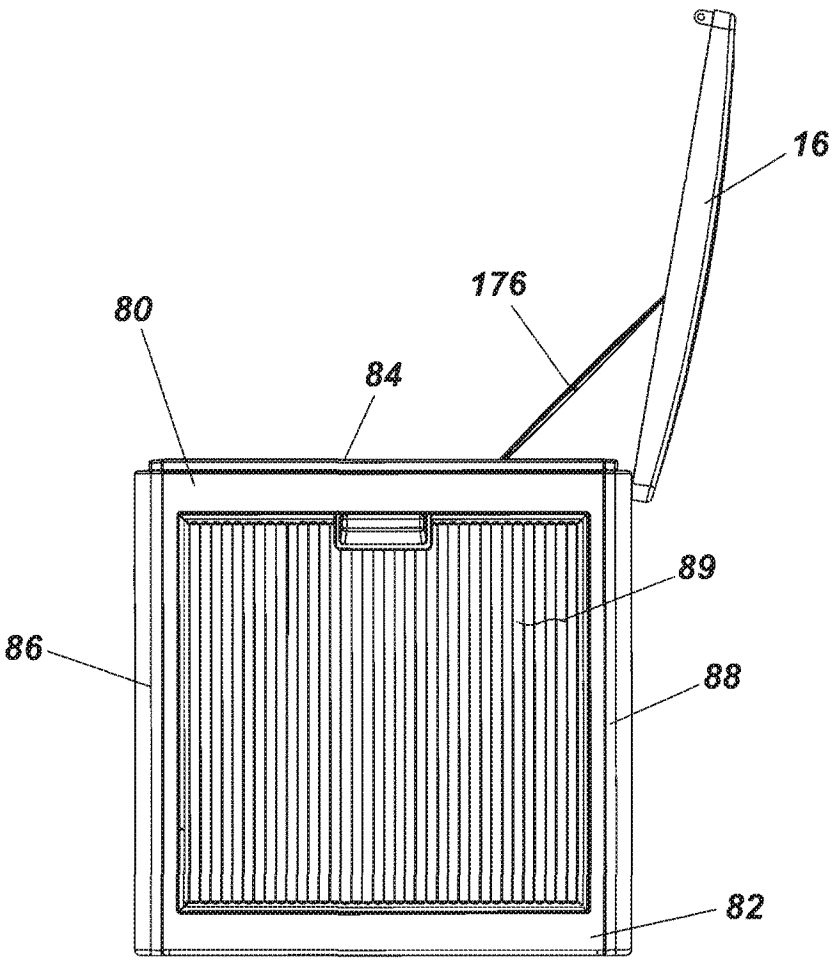
FIG. 7 is a right plane view of the deck box with the cover in the open position.
Figure 8:
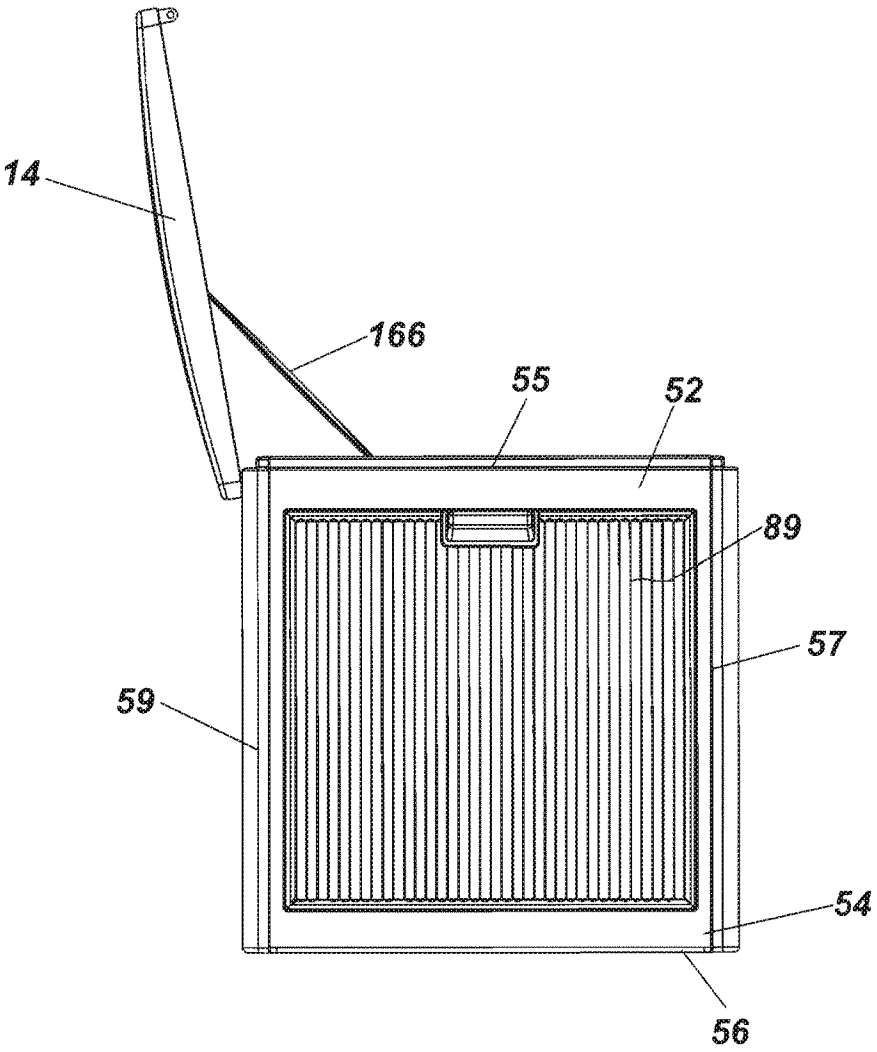
FIG. 8 is a left plane view of the deck box with the cover in the open position.
Figure 9:
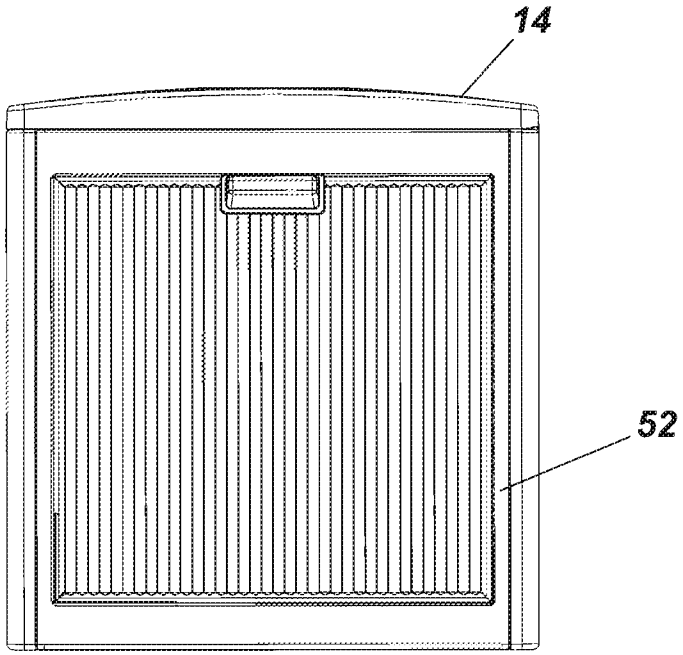
FIG. 9 is a left plane view of the deck box with the cover in the closed position.
Figure 10:
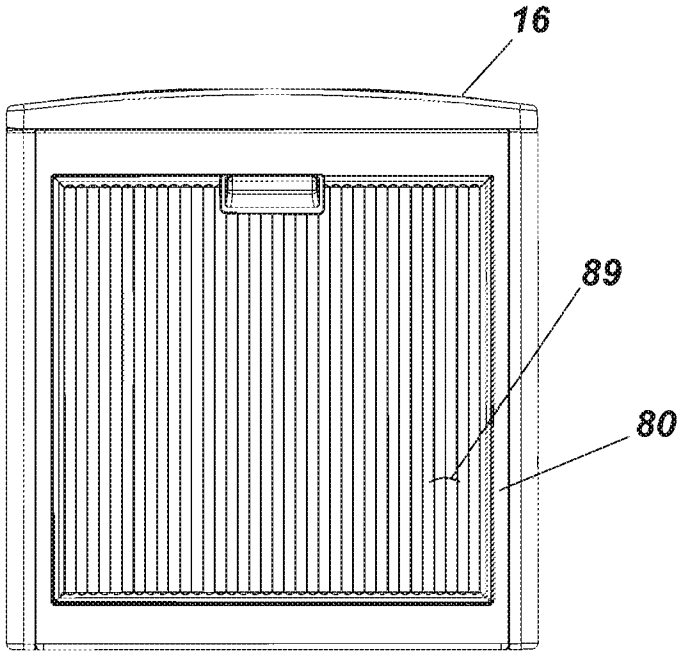
FIG. 10 is a right plane view of the deck box with the cover in the closed position.
Figure 11:
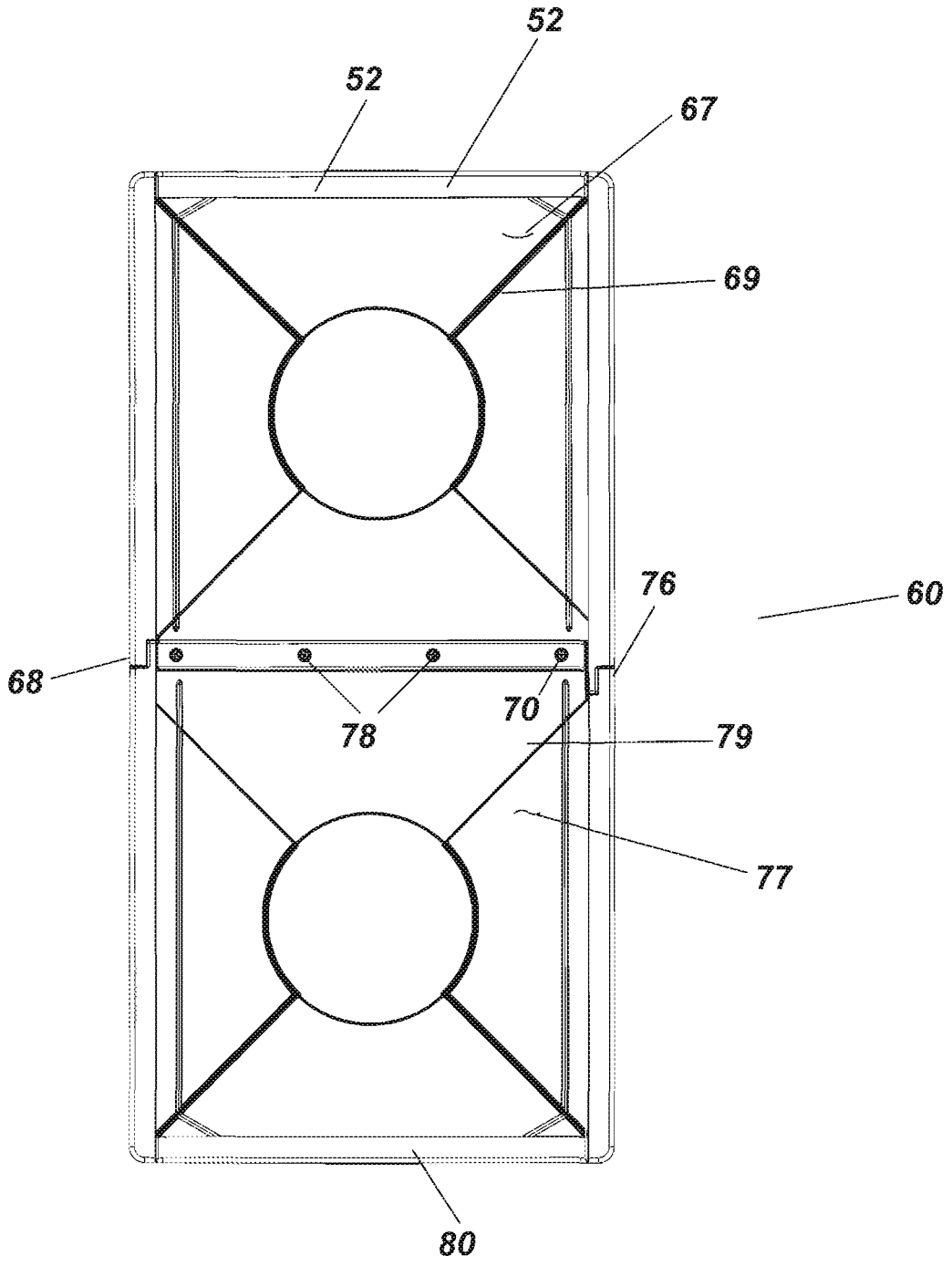
FIG. 11 is a bottom plane view of the deck box with the wall panels attached.
Figure 12:
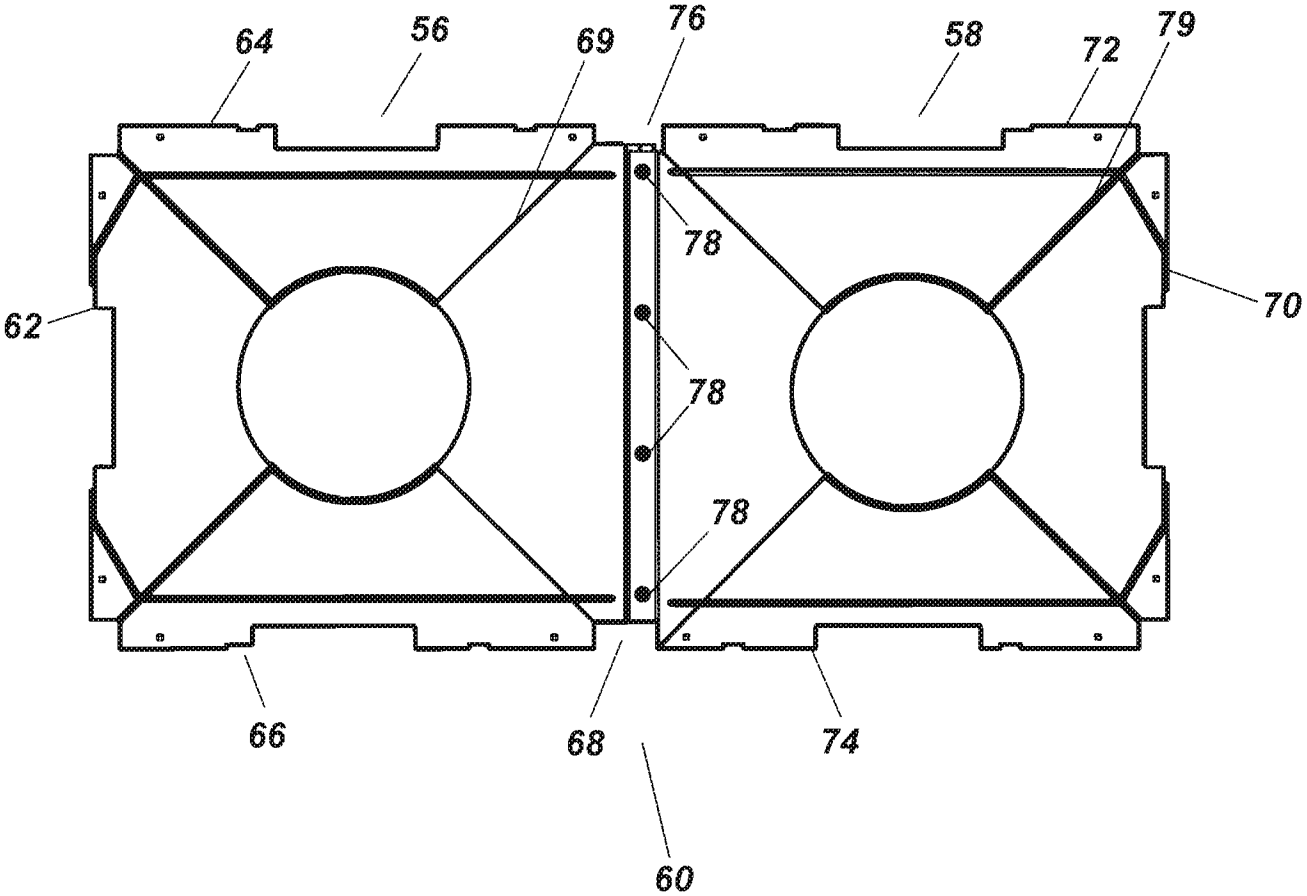
FIG. 12 is a bottom plane view with the side wall panels detached.
Figure 13:
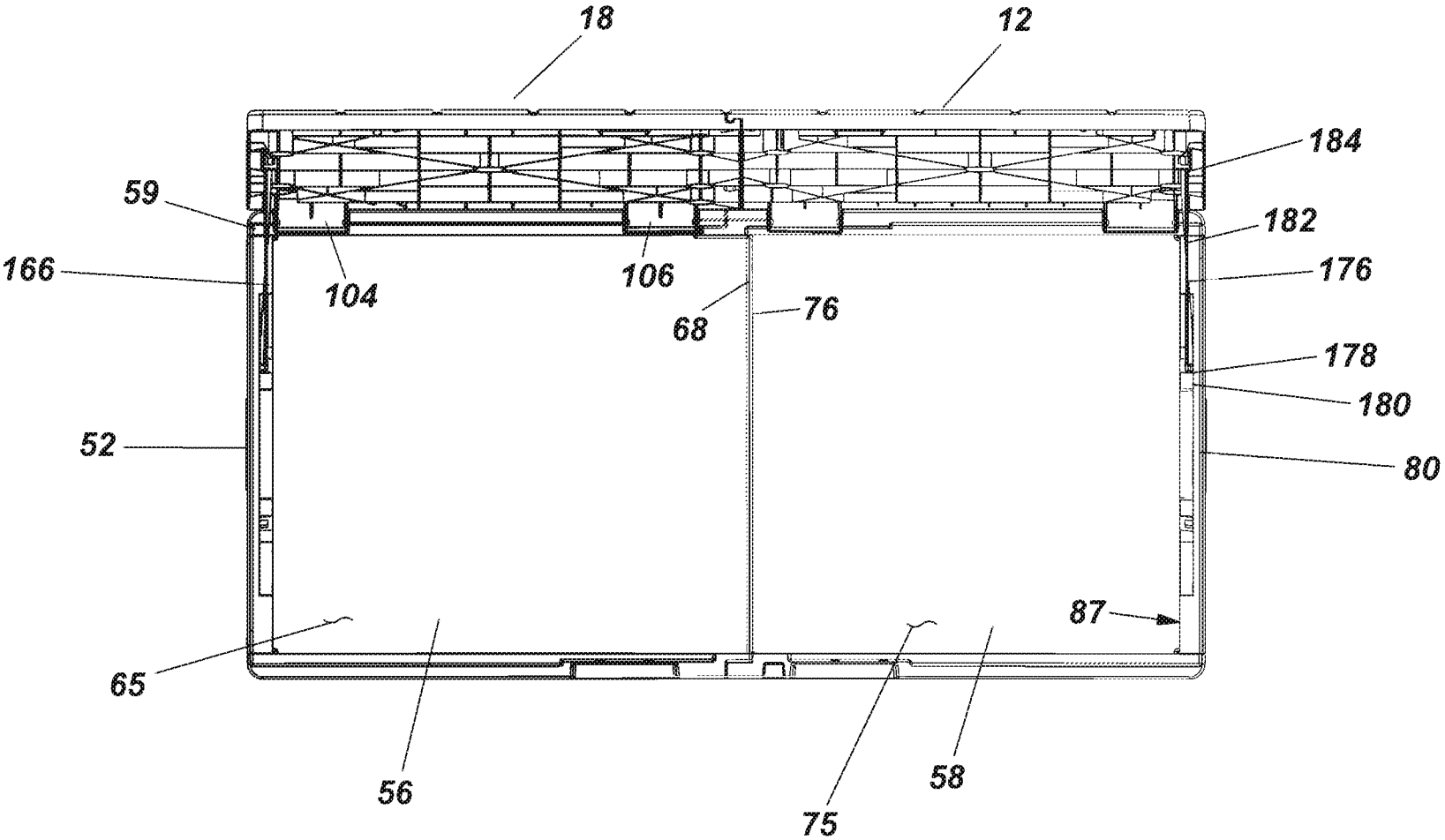
FIG. 13 is a top plane view of the deck box with the cover open.
Figure 14:
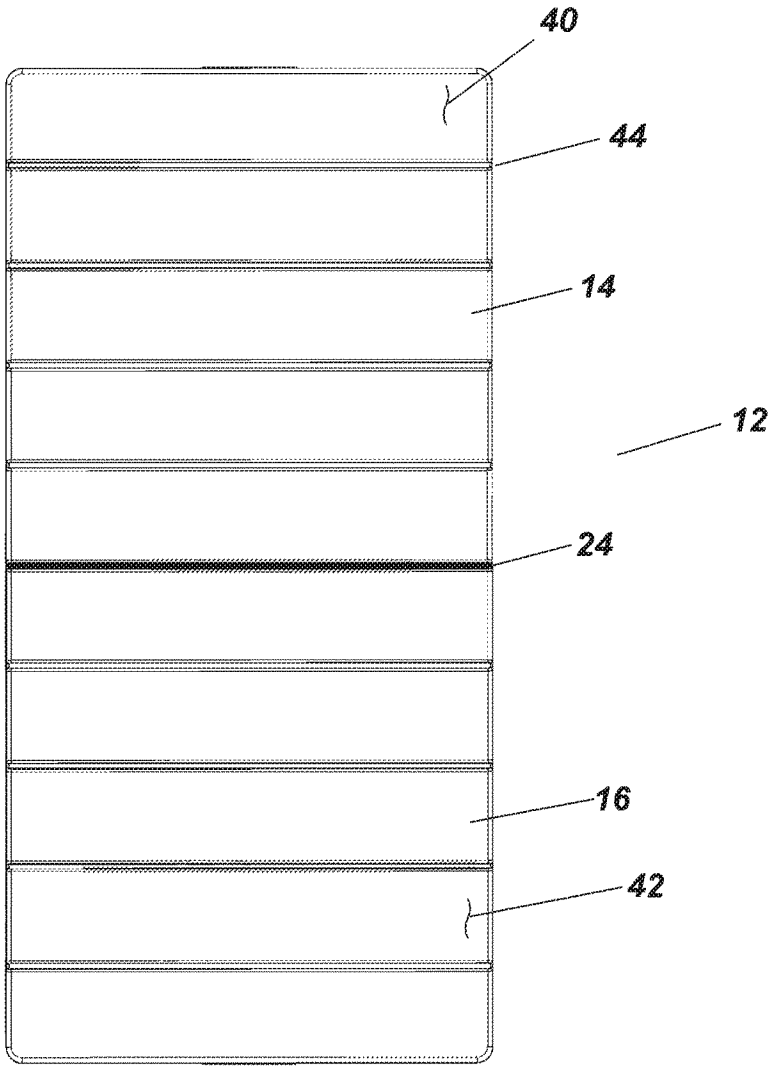
FIG. 14 is a top plane view.
Figure 15:
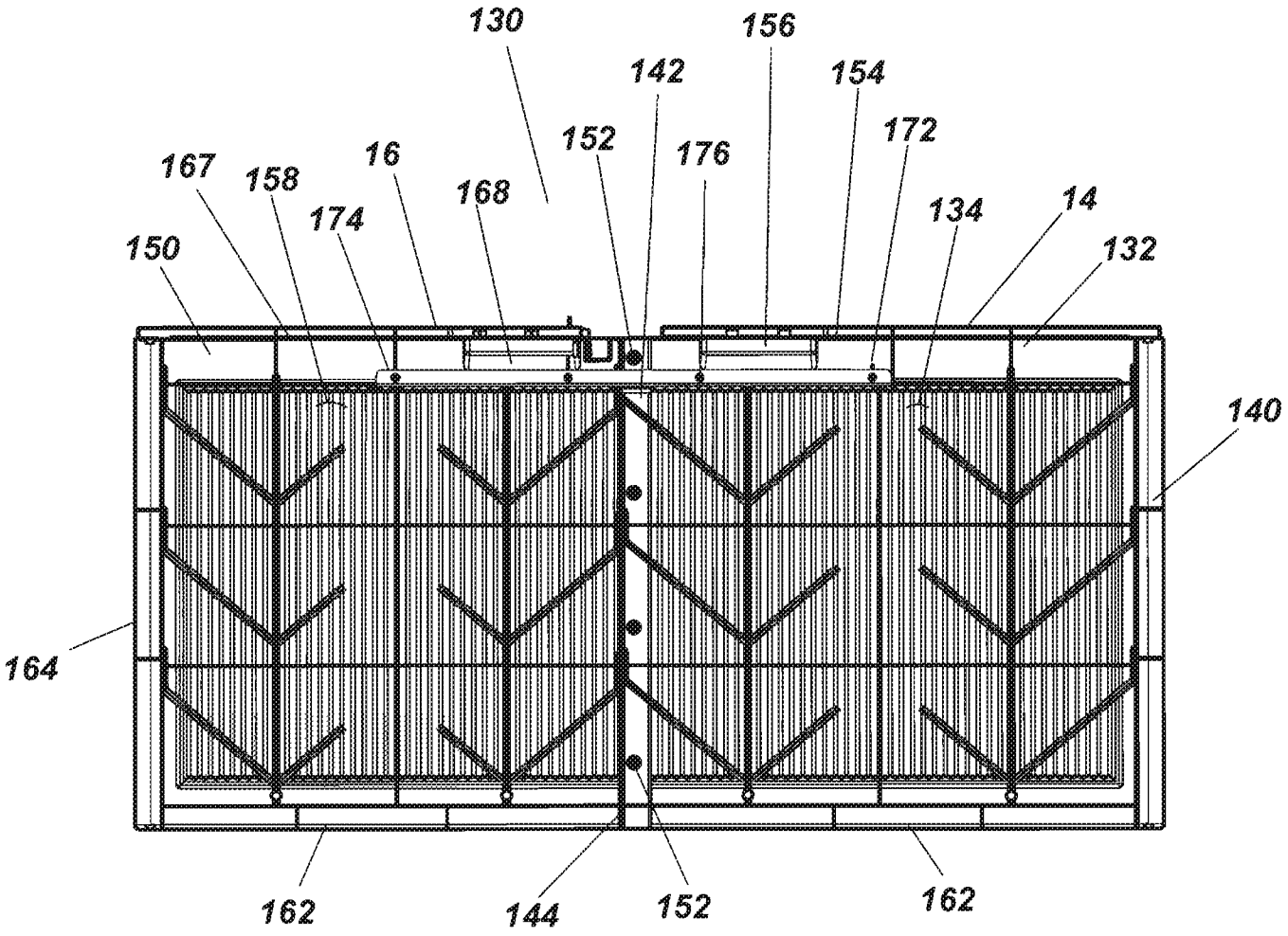
FIG. 15 is a plane view of the inner surface of the front wall.

It is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to the drawings in general, depicted is the injection molded deck box storage container 10 with a cover 12 formed from a left panel 14 and a right panel 16. The left panel 14 is defined by a front edge 18, a rear edge 20, a side edge 22 and an interconnecting edge 24; the interconnecting edge 24 having a lower extension tab 26 forming a U-shaped track 28 to prevent water from entering the deck box by underlying an upper extension tab 30 of the adjoining right panel 16. The right panel 16 is defined by a front edge 32, a rear edge 34, a side edge 36 and an interconnecting edge 38 wherein the upper extension tab 30 is constructed and arranged to allow said right panel 16 to be raised independent of said left panel 14. The upper extension tab 30 provides a shield to said U-shaped track 28 for diverting rain water from entering the storage box. The outer surfaces 40, 42 of the left panel 14 and right panel 16, respectively, have a surface configuration that may contain channels 44 to provide an ascetically pleasing appearance. The inner surfaces 46, 48 of the left panel 14 and right panel 16 are formed with integral cross-bracing, ribs and gussets 50 for increased rigidity. Injection molding allows the panels to be formed with integral cross-bracing, ribs and gussets for increased rigidity while maintaining a lightweight construction that can be easily assembled and moved. The extra rigidity substantially prevents the panels from bowing inwardly and/or outwardly to resist panel racking and separation over time to maintain an aesthetically pleasing water resistant enclosure.

A left side wall 52 is formed from a single panel having a lower edge 54 securable to a bottom wall 60. The bottom wall 60 is formed from a first bottom panel 56 secured to a second bottom panel 58. The first bottom panel 56 has a left closed edge 62, a rear closed edge 64, a front closed edge 66, and a first interconnecting edge 68; the inner surface 65 of the first bottom panel 56 having a smooth texture. The outer surface 67 of the first bottom panel 56 is formed with integral cross-bracing, ribs and gussets 69 for increased rigidity. The second bottom panel 58 has a right closed edge 70, a rear closed edge 72, a front closed edge 74, and a second interconnecting edge 76. The first interconnecting edge 68 is secured to the second interconnecting edge 76 by screw fasteners 78; the inner surface 75 of the second bottom panel 58 having a smooth texture. The outer surface 77 of the second bottom panel 58 is formed with integral cross-bracing, ribs and gussets 79 for increased rigidity. The left side wall 52 is defined by the lower edge 54, upper edge 55, front edge 57 and rear edge 59. A right side wall 80 is formed from a single panel having a lower edge 82 securable to the right closed edge 70 of the second bottom panel 58. The right side wall 80 is defined by the lower edge 82, upper edge 84, front edge 86 and rear edge 88, having an inner wall surface 87 and an outer wall surface 89.

Figure 16:
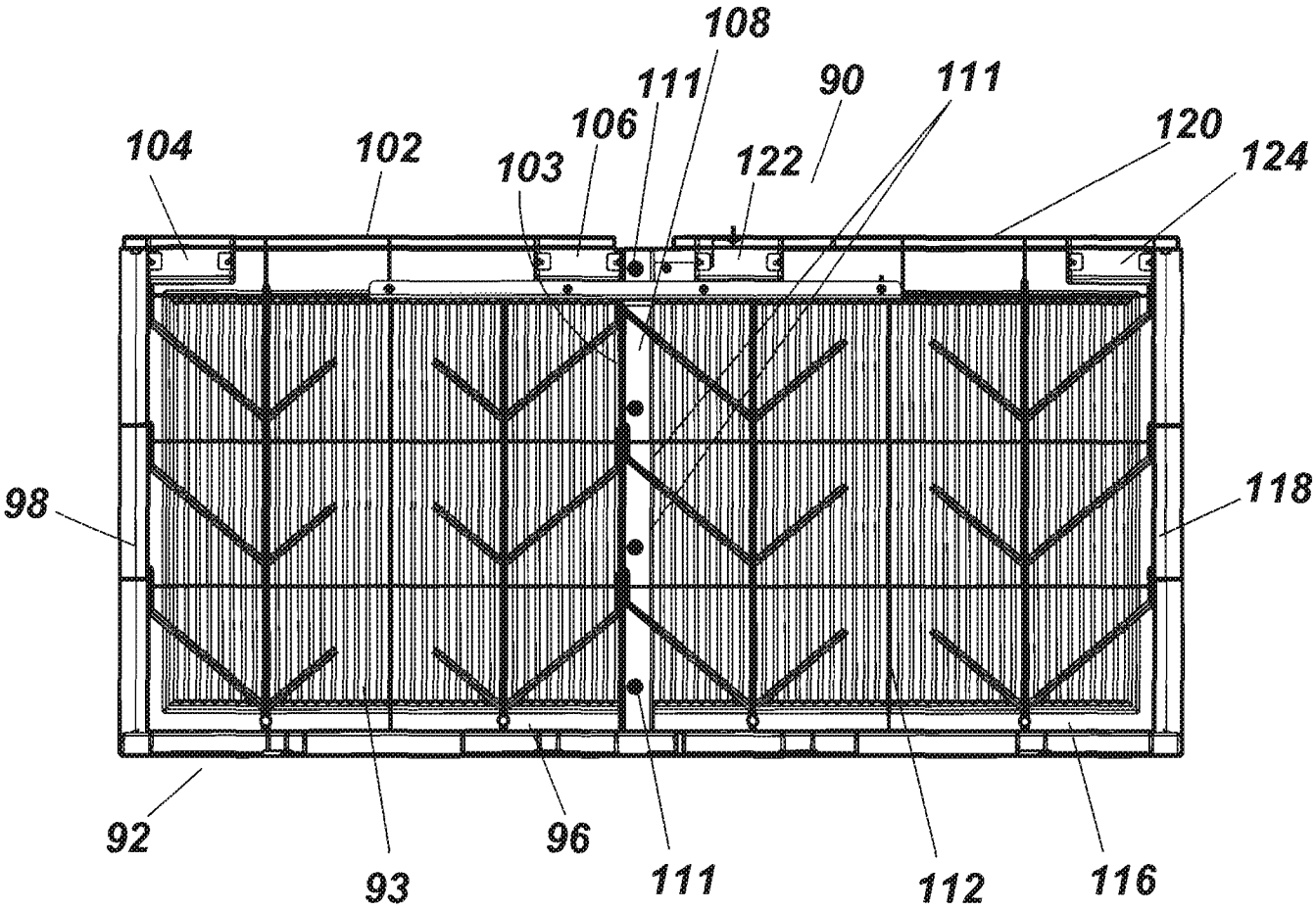
FIG. 16 is a plane view of the inner surface of the rear wall.
Figure 17:
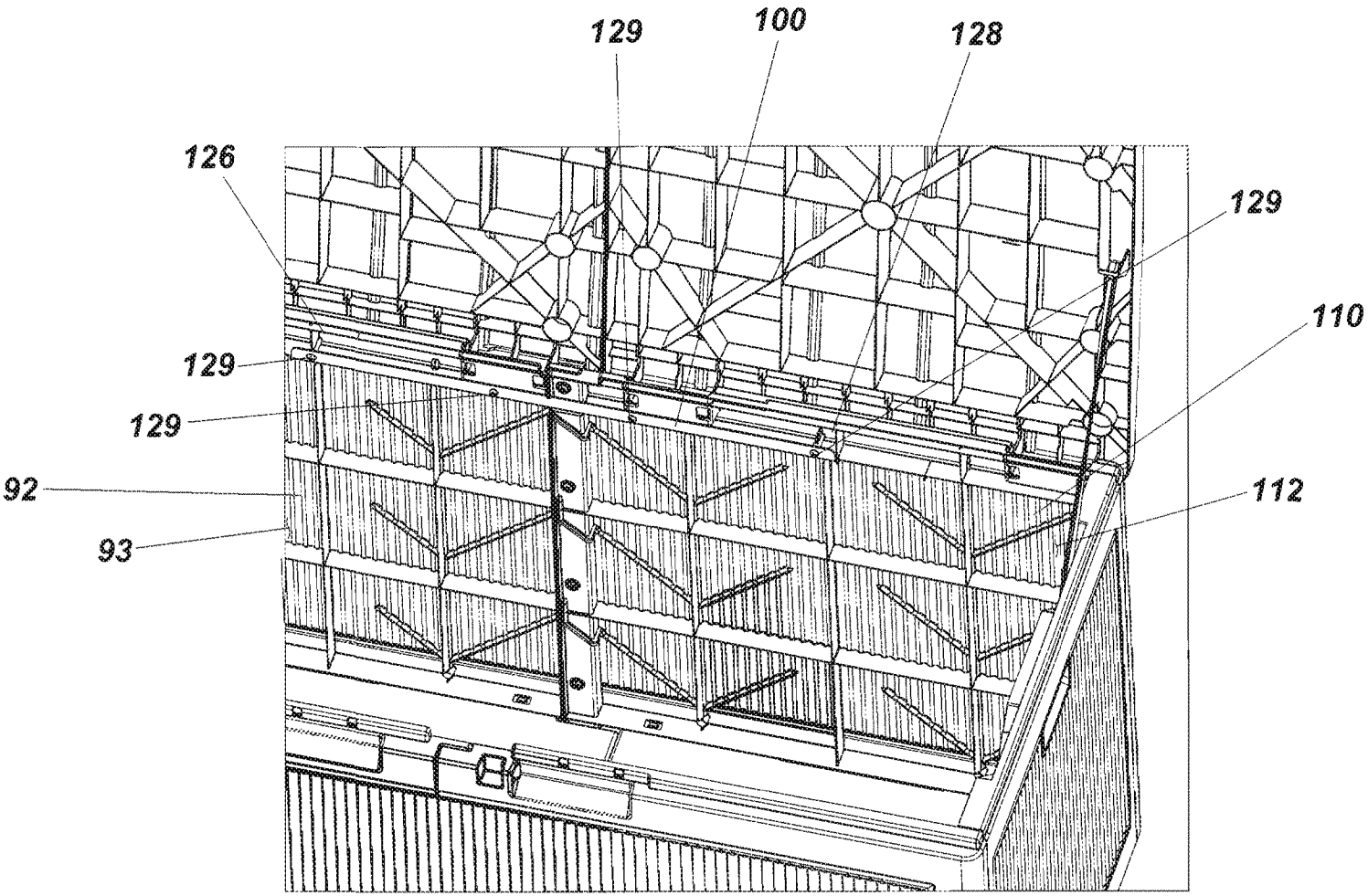
FIG. 17 is a right perspective view of the inner surface of the rear wall and cover.
Figure 18:
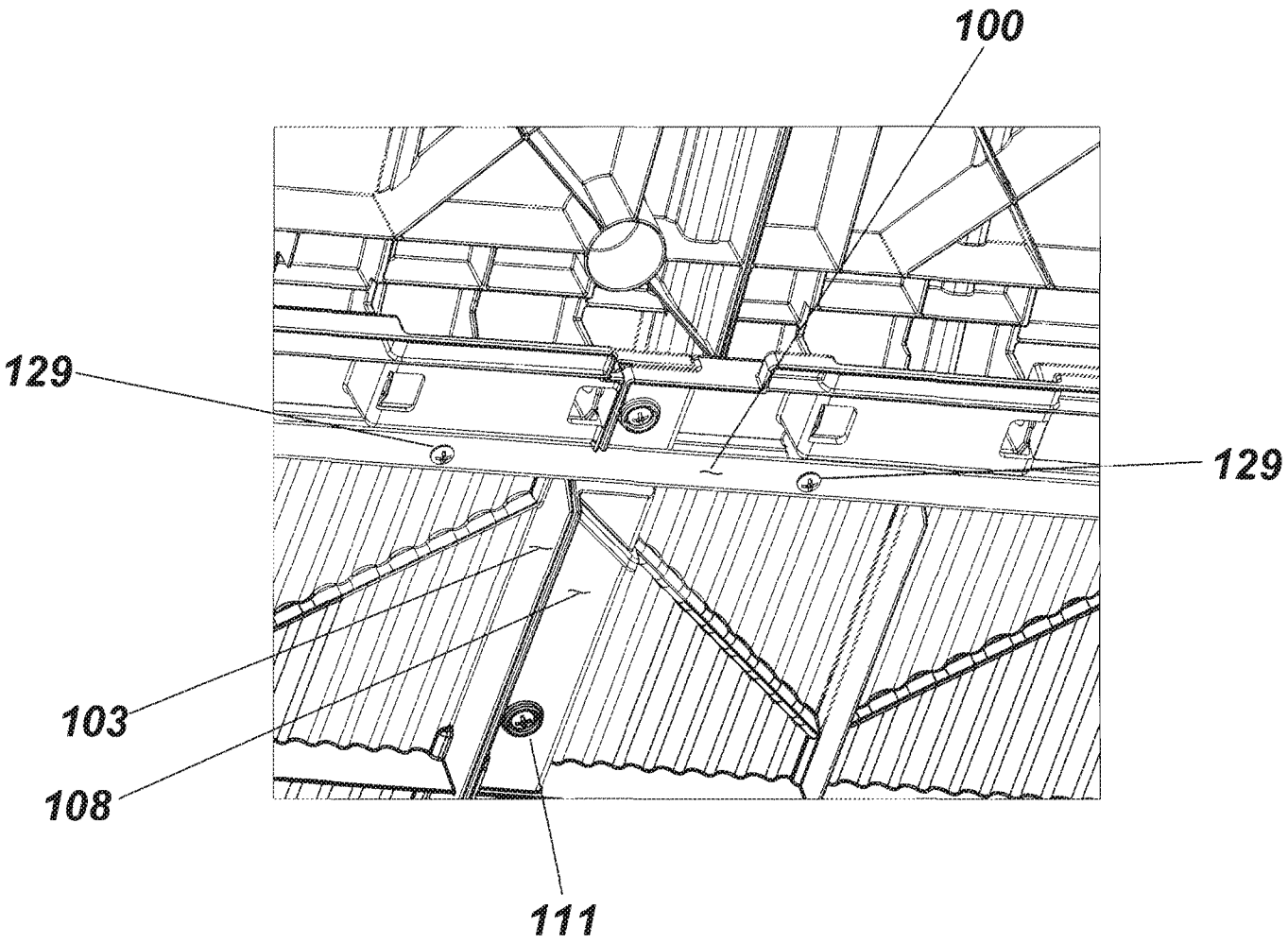
FIG. 18 is a left enlarged perspective view of the inner surface of the rear wall and cover securement.
Figure 19:
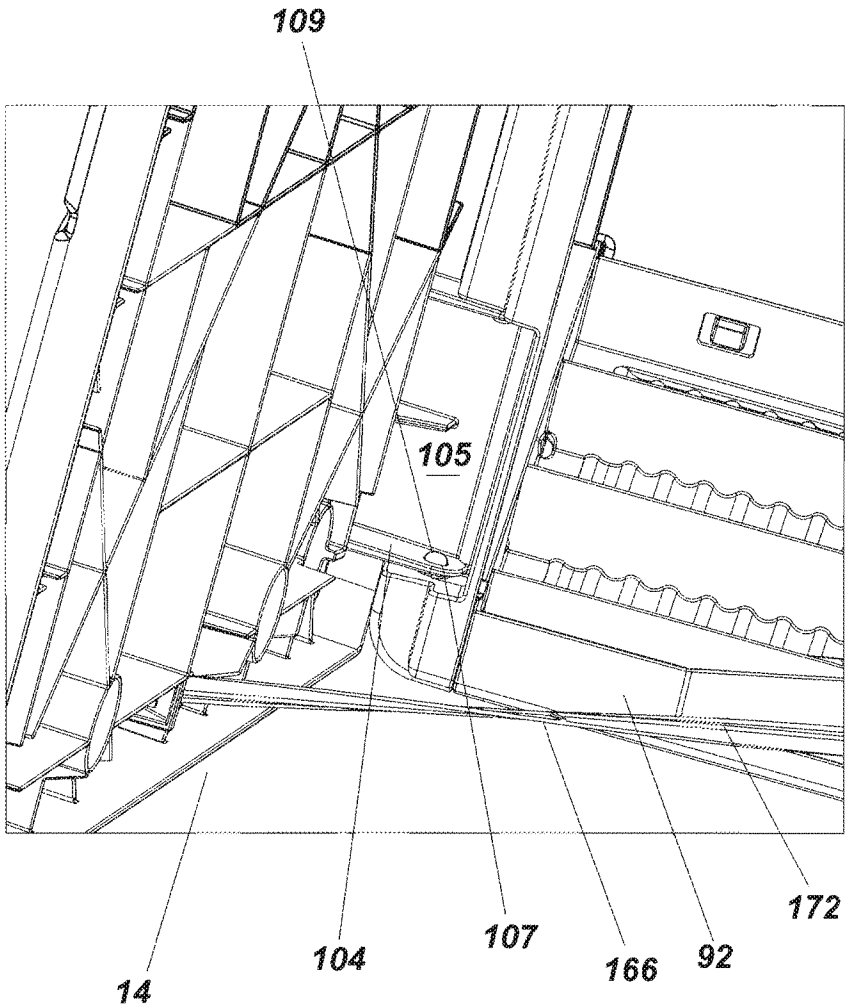
FIG. 19 is a perspective view of the hinge connector.
Figure 20:
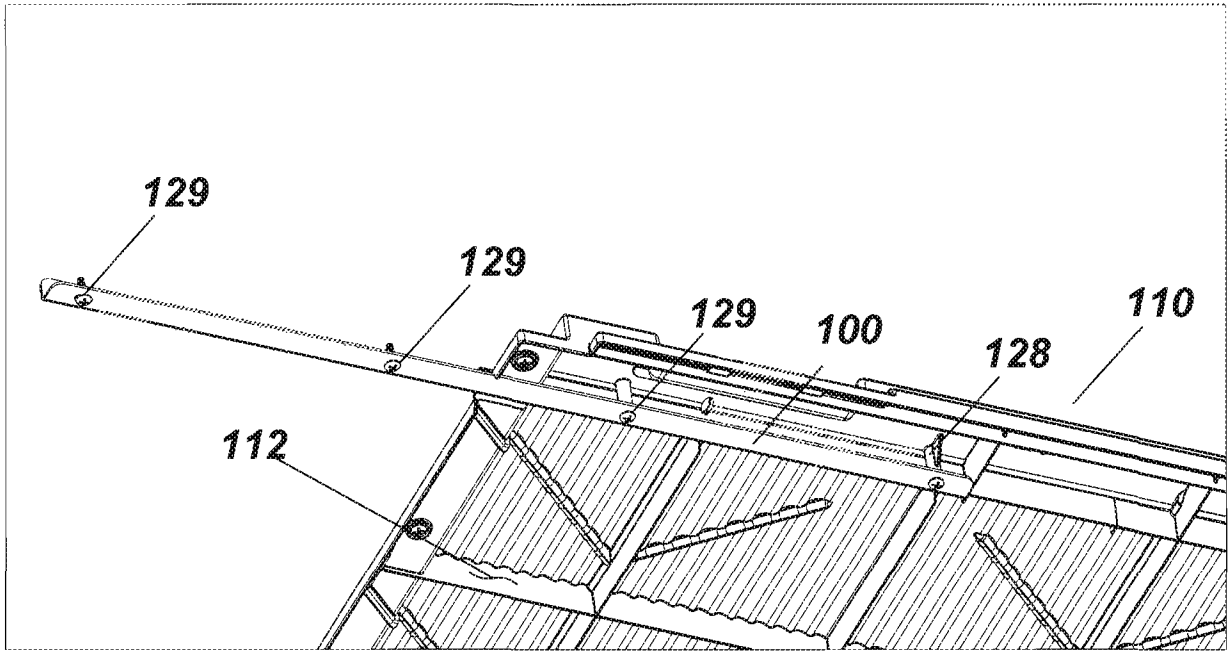
FIG. 20 is a perspective view of the right rear panel and reinforcement bracket.
Figure 21:
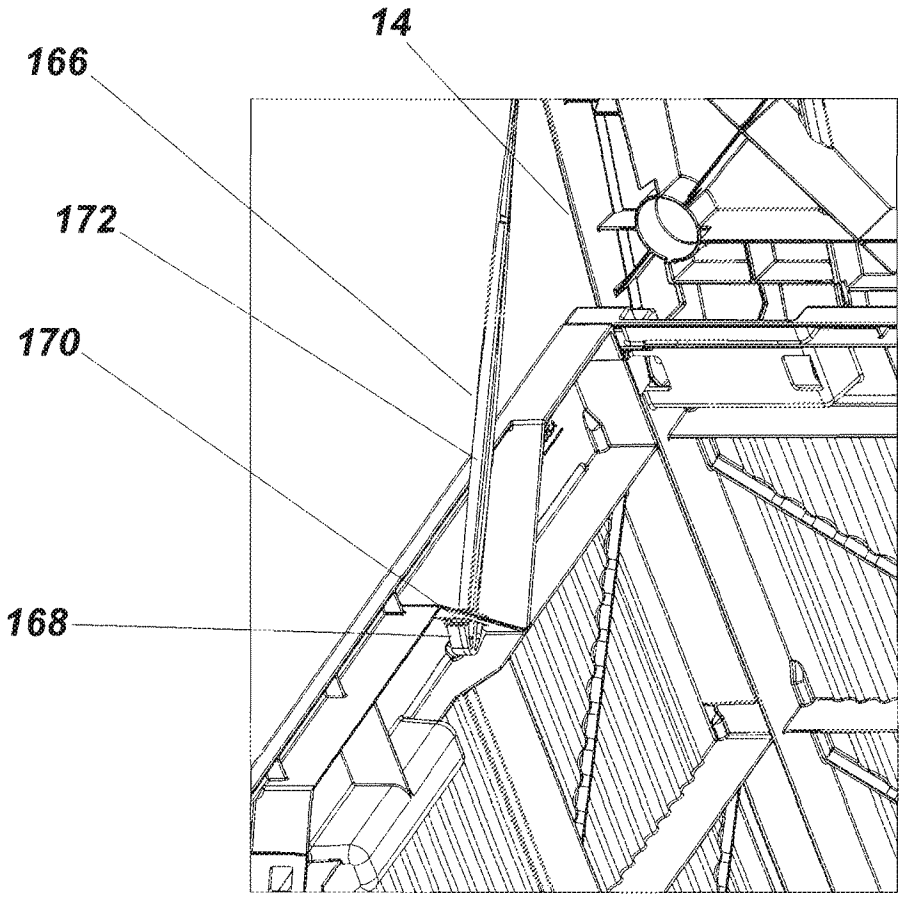
FIG. 21 is a perspective view of a cover tie back.
Figure 22:
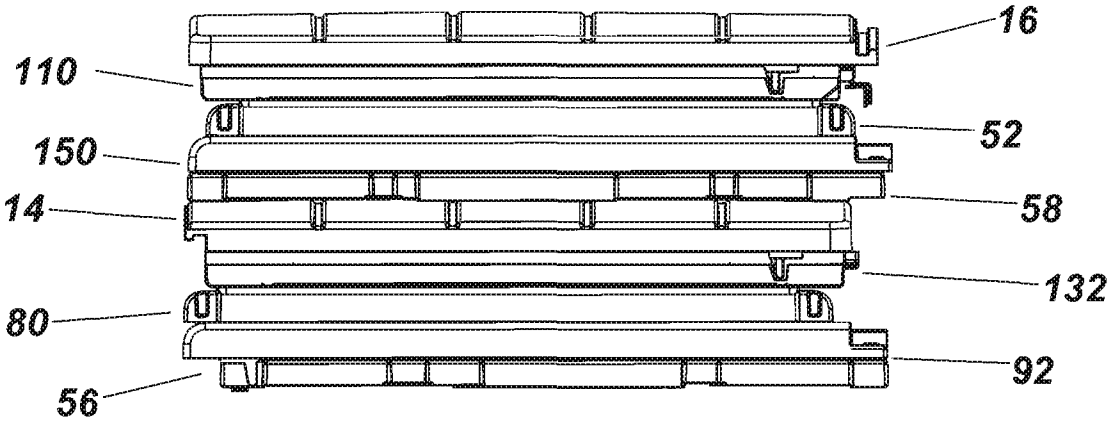
FIG. 22 is a front view of the panels in a nested and stacked position.
Figure 24:
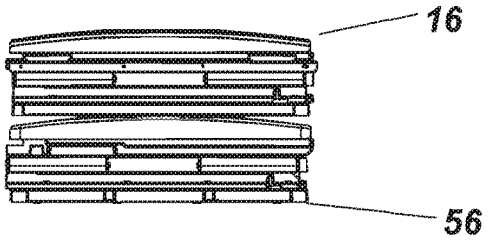
FIG. 24 is a left side view of the stacked panels.
Figure 26:
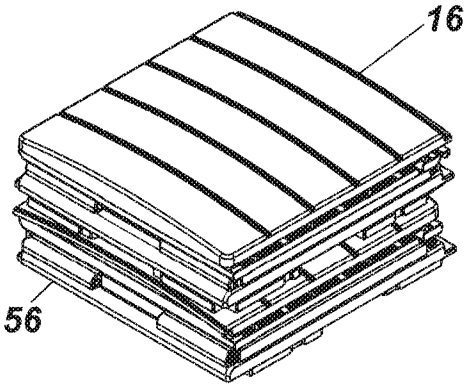
FIG. 26 is a left front perspective view of the stacked panels.
Figure 23:
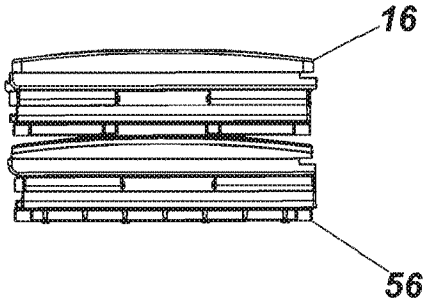
FIG. 23 is a right side view of the stacked panels.
Figure 25:
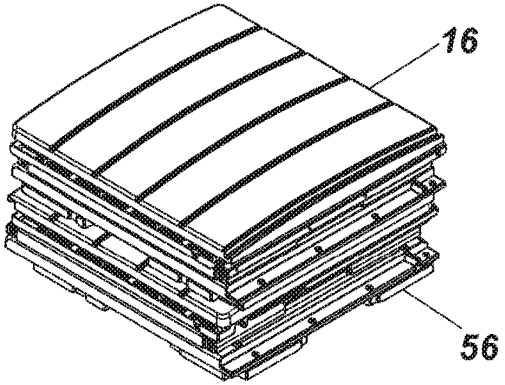
FIG. 25 is a right front perspective view of the stacked panels.
Figure 28:
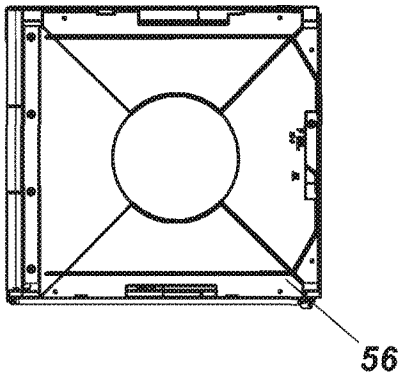
FIG. 28 is a bottom view of the stacked panels.
Figure 27:
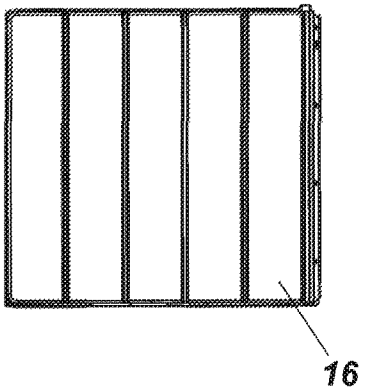
FIG. 27 is a top view of the stacked panels.
Figure 30:
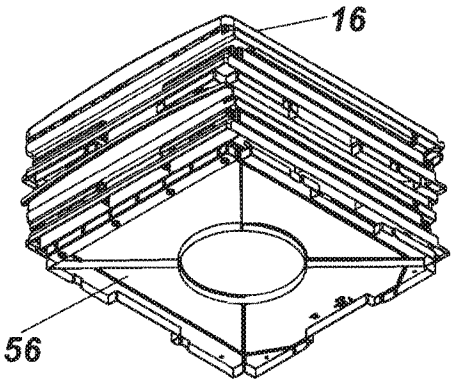
FIG. 30 is a right front perspective view of the stacked panels.
Figure 29:
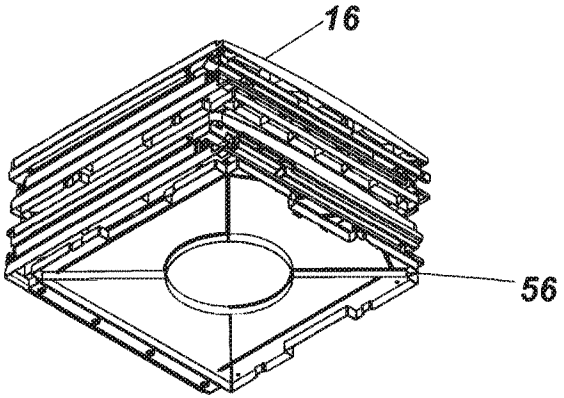
FIG. 29 is a left front perspective of the stacked panels.

A rear wall 90 is formed from a first panel 92 having an inner surface 93 and an outer surface 94 defined by a lower edge 96 secured to the closed edge 64 of the bottom wall panel 56, a left edge 98 securable to the rear edge 59 of the left side wall 52, and a right edge 103 secured to the interconnecting edge 108 of a second panel 110 by the use of screw fasteners 111. An upper edge 102 includes a first and second hinge member 104, 106, providing a hinged coupling to the left panel 14. Hinge member 104 is illustrated in FIGS. 16 and 19 depicting a bracket 105 having apertures 107 for receipt of a hinge pin 109; the hinge pin 109 extending partially into the aperture 107 allowing rotation of the left panel 14 in respect to the rear panel 92. Hinge members 106, 122, 124 operate in the same manner as hinge 104, and for ease of drawing clarity, the hinge pins and apertures are not numbered as they employ the same configuration as hinge 104. The left panel 14 is restricted in opening beyond the hinge 104, 106 range by a first tie back 166 having an arrow shaped end clasp 168 that allows placement through opening 170, wherein the tie back 166 having a rib 172 that can slide through the opening 170 when the left panel 14 is in a closed position, and allows the left panel 14 to be raised into an open position wherein the end clasp 168 is prevented from passage through the opening 170. A second end 174 of the tie back 166 is hingedly secured to the left panel 14. Similarly, right panel 16 is restricted in opening beyond the hinge 122, 124 range by a second tie back 176 having an arrow shaped end clasp 168 that allows placement through opening 170 wherein the tie back 176 having a rib 172 that can slide through the opening 170 when the right panel 16 is in a closed position, or be formed for a flexible material that will maintain an elongated length until bent. The tie back allows the right panel 16 to be raised into an open position wherein the end clasp 178 is prevented from passage through the opening 170. A second end 184 of the tie back 176 is hingedly secured to the right panel 16.

The second rear wall panel 110 has an inner surface 112 and an outer surface 114 defined by a lower edge 116 secured to the closed edge 64 of the bottom wall panel 56, a right edge 118 securable to the rear edge 88 of the right side wall 80, an upper edge 120, and the interconnecting edge 108 secured to the interconnecting edge 103 of the first panel 92. The upper edge 120 includes a second and third hinge member 122, 124 providing a hinged coupling to the right panel 16. A steel reinforcement bar 100 provides rigidity between the first panel 92 and the second panel 110. A first boss 126 provides spacing between the inner surface 93 of the first panel 92 and the reinforcement bar 100, and a second boss 128 provides spacing between the inner surface 112 of the second panel 110 and the reinforcement bar 100. The reinforcement bar 100 is attached by screw fasteners 129. The bosses provide a stand-off to provide rigidity to the rear wall; the reinforcement bar 100 bridging the interconnecting edges 103 and 108.

A front wall 130 is formed from a first panel 132 having an inner surface 134 and an outer surface 136 defined by a lower edge 138 secured to the front closed edge 74 of the bottom wall panel 58, a left edge 140 securable to the left closed edge 62 of the left side wall 52, and a right edge 142 secured to interconnecting edge 144 of a second panel 150 by the use of screw fasteners 152. An upper edge 154 includes a first indentation 156 to allow an individual to place their fingers into the indentation for purposes of raising the cover 12. The second panel 150 has an inner surface 158 and an outer surface 160 defined by a lower edge 162 secured to the closed edge 66 of the bottom wall panel 56, a left edge 164 securable to the front edge 18 of the right side wall 80, an upper edge 167, and the interconnecting edge 142 secured to interconnecting edge 144 of the first panel 132. The upper edge 167 includes a second indentation 168 for purposes of raising the cover 12. A steel reinforcement bar 170 provides rigidity between the first panel 132 and the second panel 150. A first boss 172 provides spacing between the inner surface 134 of the first panel 132 and the reinforcement bar 170, and a second boss 174 provides spacing between the inner surface 158 of the second panel 150. The reinforcement bar 170 is attached by screw fasteners 176. The bosses provide a stand-off to provide rigidity to the front wall; the reinforcement bar 170 bridging the interconnecting edges 142 and 144.

The split panels allow stacking in a substantially square configuration as depicted by FIGS. 22-30. In addition, the stacking allows nesting of the panels, wherein protrusions are configured to align within gussets for compact storage. In the depicted configuration, the panels are nested for compact storage, with the upper panel consisting of right cover panel 16, on second bottom wall panel 58, second rear wall panel) 110, left side wall panel 52, front wall second panel 150, left cover panel 14, left front wall first panel 132, right side wall panel 80, left back rear wall first panel 92, and left floor first bottom wall panel 56.

Figure 31:
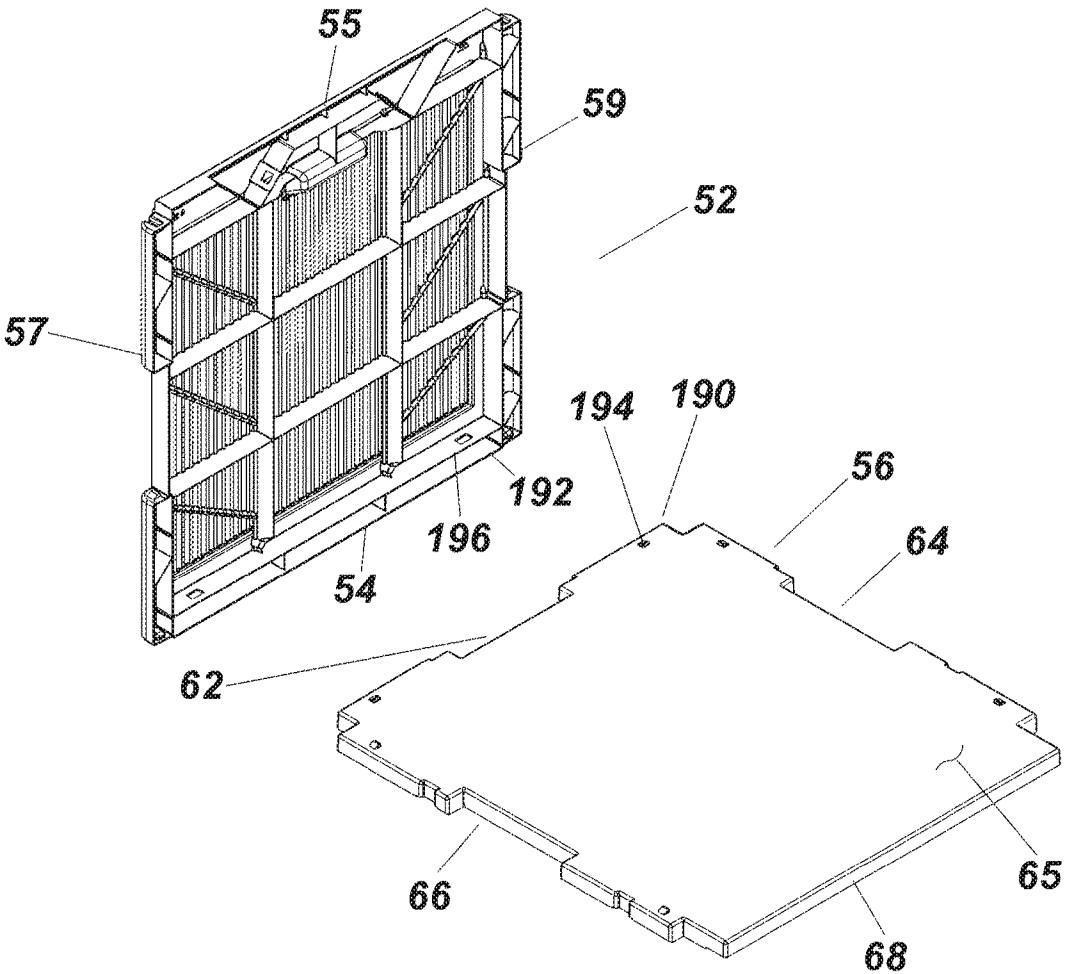
FIG. 31 is an exploded view of a side wall and a bottom panel.

Referring to FIG. 31, illustrated is the left wall 52 in an exploded position with bottom panel 56. The bottom panel having a left edge 62 forming a protrusion 190 constructed and arranged for receipt by left wall 52 receptacle 192. The protrusion 190 including an integral ramp faced fastener 194 that allows ease of fitting into the receptacle 192 for engaging locking aperture 196, allowing a snap together engagement. For ease of drawing clarity, only a single ramp fastener 194 for enumerated. However, it will be understood that ramp fasteners and locking aperture are used to secure the walls to the floor, and edges of the front and rear walls to the side walls. Similarly, it will be noted that the use of protrusions 190 are along the edges for insertion into the receptacles 192 providing rigidity to the walls and floor.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A deck storage box comprising:

a bottom wall formed from two panels having an interconnecting edge, each said panel having a top surface, a bottom surface and four closed edges;

a left side wall formed from a single panel having a lower edge securable to one said closed edge of said bottom wall, said left side wall having an inner surface and an outer surface and four side edges;

a right side wall formed from a single panel having a lower edge securable to one said closed edge of said bottom wall, said right side panel having an inner surface and an outer surface and four edges;

a rear wall formed from two panels having an interconnecting edge, said two panels defining a first panel and a second panel each having an inner surface and an outer surface defined by a lower edge secured to one side closed edge of said bottom wall, a left edge of one said panel securable to a left side wall edge, a right edge of a second panel securable to a right side wall edge, and a bottom edge of each said panel securable to said bottom wall;

a rear steel reinforcement bar secured to said rear wall bridging said interconnecting edges of said first panel of said rear wall and said second panel of said rear wall, wherein said rear steel reinforcement bar provides rigidity between said first panel of said rear wall and said second panel of said rear wall;

a front wall formed from two panels defining a first panel and a second panel having an interconnecting edge, said front wall having a right edge securable to a right side wall edge, a left edge securable to a left side wall edge, and a bottom edge securable to said bottom wall;

a front steel reinforcement bar secured to said front wall bridging said interconnecting edges of said first panel of said front wall and said second panel of said front wall, wherein said front steel reinforcement bar provides rigidity between said first panel of said front wall and said second panel of said front wall; and a cover for enclosing and overlapping a cavity formed by said walls, said cover formed from a left panel having a front edge, a rear edge, a side edge, and a first interconnecting edge with a lower extension tab and a right panel having a front edge, a rear edge, a side edge, and a second interconnecting edge with an upper extension tab, said lower extension tab constructed and arranged to allow both said left panel and said right panel to be raised simultaneously to provide access to said cavity or said right cover panel to be raised independent of said left cover panel to provide access to said cavity, said lower extension tab and said upper extension tab forming a continuous U-shaped track from said front edge to said rear edge constructed and arranged to divert rain water from entering said cavity;

whereby said panels that form said front wall, said rear wall, said bottom wall and said cover are approximately the same dimension as said left side wall and said right side wall to allow stacking of said panels, wherein said deck storage box can be shipped in a disassembled state in a substantially square package and assembled at a desired site.

2. The deck storage box according to claim 1 wherein each said interconnecting edge includes a reciprocal lip to overlap an adjoining interconnecting edge.

3. The deck storage box according to claim 2 wherein said interconnecting edges are secured together by screw fasteners.

4. The deck storage box according to claim 1 wherein said panels are constructed and arranged to be nested in the stacked configuration to lessen spacing between panels.

5. A deck storage box comprising:

a bottom wall formed from two panels having an interconnecting edge securing said two panels together, said two panels having a top surface, a bottom surface and four closed edges;

a left side wall formed from a single panel having a lower edge securable to one said closed edge of said bottom wall for enclosing a left side of said deck storage box; said left side wall having an inner surface and an outer surface and four side edges;

a right side wall formed from a single panel having a lower edge securable to one said closed edge of said bottom wall for enclosing a right side of said deck storage box, said right side panel having an inner surface and an outer surface and four edges;

a rear wall formed from two panels defining a first panel and a second panel having an interconnecting edge securing said two panels together, said two panels each having an inner surface and an outer surface defined by a lower edge secured to one side closed edge of said bottom wall, a left edge of one said panel securable to a left side wall edge, a right edge of a second panel securable to a right side wall edge, and a bottom edge of each said panel securable to said bottom wall for enclosing the rear side of said deck storage box;

a rear steel reinforcement bar secured to said rear wall bridging said interconnecting edges of said first panel of said rear wall and said second panel of said rear wall, wherein said rear steel reinforcement bar provides rigidity between said rear first panel of said rear wall and said second panel of said rear wall;

a front wall formed from two panels defining a first panel and a second panel having an interconnecting edge securing said two panels together, said front wall having a right edge securable to a right side wall edge, a left edge securable to a left side wall edge, and a bottom edge securable to said bottom wall for enclosing the front side of said deck storage box and forming a cavity between said walls;

a front steel reinforcement bar secured to said front wall bridging said interconnecting edges of said first panel of said front wall and said second panel of said front wall, wherein said front steel reinforcement bar provides rigidity between said front first panel of said front wall and said second panel of said front wall; and a cover for enclosing and overlapping said cavity, said cover formed from a left panel and a right panel, said left panel having a front edge, a rear edge, a side edge, and an interconnecting edge with a lower extension tab for adjoining a right panel having a front edge, a rear edge, a side edge, and an interconnecting edge with an upper extension tab, said lower extension tab constructed and arranged to allow both said left panel and said right panel to be raised simultaneously to provide access to said cavity said right cover panel to be raised independent of said left cover panel to provide access to said cavity, said lower extension tab and said upper extension tab forming a continuous U-shaped track from said front edge to said rear edge constructed and arranged to divert rain water from entering said cavity, said rear edge of said cover hingedly secured to a top edge of said rear wall, said cover constructed and arranged to provide access to said cavity;

whereby said two panels that form said front wall, said rear wall, said bottom wall and said cover are approximately the same length and height as said left side wall and said right side wall to allow stacking of said panels, wherein said deck storage box can be shipped in a disassembled state in a substantially square package and assembled at a desired site.

6. The deck storage box according to claim 5 wherein each said interconnecting edge having a reciprocal lip constructed and arranged to overlap an adjoining interconnecting edge, said interconnecting edges secured together by at least one screw fastener.

7. The deck storage box according to claim 6 wherein said interconnecting edges include a plurality of apertures for receipt of said screw fasteners.

8. The deck storage box according to claim 5 wherein said panels are constructed and arranged to be nested in the stacked configuration to lessen spacing between panels.

9. The deck storage box according to claim 5 wherein said front steel reinforcement bar increases the structural integrity of said deck box by inhibiting said panels from bowing or bending inwardly or outwardly between said two panels forming said front wall.

10. The deck storage box according to claim 5 wherein said rear steel reinforcement bar increases the structural integrity of said deck box by inhibiting said panels from bowing or bending inwardly or outwardly of said two panels forming said rear wall.

11. The deck storage box according to claim 5 wherein said interconnecting extension tabs are constructed and arranged to allow said right cover panel to be raised independent of said left cover panel to provide access to said cavity.

12. The deck storage box according to claim 5 wherein each panel includes integrally formed cross-bracing; wherein said cross-bracing provides increased weight capacity and stability to said deck storage box.

* * * * *